US006926055B1

(12) United States Patent
Colson et al.

(10) Patent No.: US 6,926,055 B1
(45) Date of Patent: Aug. 9, 2005

(54) NON-WOVEN COMPOSITE FABRIC AND METHOD AND APPARATUS FOR MANUFACTURING SAME

(75) Inventors: Wendell B. Colson, Weston, MA (US); Paul G. Swiszcz, Boulder, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 435 days.

(21) Appl. No.: 10/088,613

(22) PCT Filed: Sep. 20, 2000

(86) PCT No.: PCT/US00/25793

§ 371 (c)(1),
(2), (4) Date: Jul. 1, 2002

(87) PCT Pub. No.: WO01/21383

PCT Pub. Date: Mar. 29, 2001

Related U.S. Application Data

(60) Provisional application No. 60/154,717, filed on Sep. 20, 1999.

(51) Int. Cl.[7] ..... B65H 81/00
(52) U.S. Cl. ..... 156/441; 156/425; 156/426; 156/428; 156/433
(58) Field of Search ..... 156/425, 426, 156/428, 433, 441

(56) References Cited

U.S. PATENT DOCUMENTS

| | | | | |
|---|---|---|---|---|
| 2,093,206 A | * | 9/1937 | Muller | 156/432 |
| 2,797,728 A | | 7/1957 | Slayter et al. | 154/1.7 |
| 3,041,230 A | * | 6/1962 | Diehl | 156/426 |
| 3,496,053 A | * | 2/1970 | Jenkins et al. | 156/181 |
| 3,591,434 A | | 7/1971 | Hartstein | 156/178 |
| 3,663,331 A | | 5/1972 | Solbeck | 156/181 |
| 3,686,048 A | | 8/1972 | Schirtzinger | 156/161 |
| 3,736,210 A | * | 5/1973 | Kaczerginski | 156/431 |
| 3,737,950 A | | 6/1973 | Bolliand et al. | 19/65 T |
| 4,132,828 A | | 1/1979 | Nakamura et al. | 428/366 |

(Continued)

FOREIGN PATENT DOCUMENTS

CA 889 808 1/1972

(Continued)

OTHER PUBLICATIONS

International Search Report (Hunter Douglas Inc., et al) PCT/US00/00571; Int'l Filing date Oct. 1, 2000.

(Continued)

*Primary Examiner*—Jeff H. Aftergut

(57) ABSTRACT

An apparatus for fabricating a unique non-woven fabric which has the appearance of a woven fabric includes a supply station for adhesive coated parallel warp yarns, a support structure for orienting the parallel warp yarns into a cylindrical orientation with the adhesive coating on the outside, a weft yarn applicator for wrapping weft yarns around the cylindrically oriented warp yarns, a heating station for activating the adhesive and a cooling station for setting the adhesive, and a cutter for severing the cylindrically formed fabric composite so that it can be flattened and wrapped onto a take-up roller. The weft yarn applicator includes a rotating drum wherein a plurality of spools of weft yarn material are mounted in circumferentially spaced relationship. Tension on the weft yarns is provided by the rotation of the drum (centrifugal force) and a stationary conical aligner is used to guide the weft yarn material onto the warp yarns in substantially perpendicular alignment.

27 Claims, 7 Drawing Sheets

U.S. PATENT DOCUMENTS

| | | | | |
|---|---|---|---|---|
| 4,265,691 | A * | 5/1981 | Usui | 156/172 |
| 4,411,722 | A | 10/1983 | Yazawa et al. | 156/167 |
| 4,498,941 | A | 2/1985 | Goldsworthy | 156/148 |
| 4,511,424 | A * | 4/1985 | Usui | 156/426 |
| 4,687,528 | A | 8/1987 | Held | 156/150 |
| 5,061,545 | A | 10/1991 | Li et al. | 428/195 |
| 5,097,783 | A | 3/1992 | Linville | 114/103 |
| 5,558,016 | A | 9/1996 | De Brock | 100/93 P |
| 5,965,262 | A * | 10/1999 | Whisler et al. | 428/373 |
| 6,494,980 | B1 * | 12/2002 | Rothemeyer et al. | 156/431 |

FOREIGN PATENT DOCUMENTS

| | | |
|---|---|---|
| DE | 30 46 432 A1 | 8/1982 |
| DE | 30 46 431 A1 | 9/1982 |
| EP | 0 255 596 | 2/1988 |
| EP | 0 292 266 A2 | 11/1988 |
| EP | 0 470 584 A2 | 6/1991 |
| EP | 0 885 803 A2 | 12/1998 |
| GB | 1 440 081 | 6/1976 |
| GB | 1 463 969 | 2/1977 |
| GB | 2 041 028 | 9/1980 |
| JP | 63-267525 | 11/1988 |
| JP | 01-210318 | 8/1989 |
| WO | WO 80/02850 | 12/1980 |
| WO | WO 00/41523 | 7/2000 |
| WO | WO 01/21383 A1 | 3/2001 |
| WO | WO 01/21399 A1 | 3/2001 |
| WO | WO 01/21877 A1 | 3/2001 |

OTHER PUBLICATIONS

International Search Report (Hunter Douglas Inc., et al) PCT/US00/25680; Int'l Filing date Sep. 20, 2000.

International Search Report (Hunter Douglas Inc., et al) PCT/US00/25681; Int'l Filing date Sep. 20, 2000.

International Search Report (Hunter Douglas Inc., et al.) PCT/US00/25793; Int'l Filing date Sep. 20, 2000.

U.S. Appl. No. 09/869,941, filed Jan. 4, 2002 corresponds to PCT International Publication WO 00/41523 reference above as letter BM.

U.S. Appl. No. 10,088,576, filed Mar. 19, 2002 corresponds to PCT International Publication No. WO 01/21399 A1 referenced above as letter BN.

U.S. Appl. No. 10/088,614, filed Mar. 19, 2002 corresponds to PCT International Publication No. WO 01/21877 A1 referenced above as letter BO.

* cited by examiner

NON-WOVEN COMPOSITE FABRIC AND METHOD AND APPARATUS FOR MANUFACTURING SAME

CROSS-REFERENCE TO RELATED APPLICATION

This application is the Section 371(c) filing of copending PCT Application No. PCT/US00/25793, filed 20 Sep. 2000, which designated the United States and was published in the English language as WO 01/21383 on 29 Mar. 2001. The PCT Application claims priority from the following copending and commonly owned provisional application, U.S. Ser. No. 60/154,717, filed 20 Sep. 1999, the disclosure of which is hereby incorporated herein by reference.

FIELD OF THE INVENTION

The present invention relates to non-woven fabric materials and, more particularly, to a composite fabric which includes at least two non-woven fabric layers; a first non-woven layer having yarns aligned in the machine direction; and a second non-woven layer having yarns aligned substantially perpendicular to the machine direction, along with an apparatus and method for manufacturing the same.

SUMMARY OF THE INVENTION

In the present invention, two non-woven yarn substrates are combined into a composite structure, which, after lamination, preferably pressure lamination, has a variety of uses. In particular, either before, or after lamination, the composite fabric of the present invention has the general appearance of a woven fabric.

Reference to the term yarn will be made throughout the description of the invention and the term should be broadly interpreted to include mono and multi-filament yarns and strands of material. The yarns may be large or small in diameter or denier, and can be made from many types of materials including but not limited to polyester, polyethylene, polypropylene, polyaramid and other polymers or plastics; wool, cotton, hemp and other natural fibers; blends of natural and/or synthetic fibers; glass, metal, graphite and the like. It is conceivable that some of the warp and/or weft yarns may be copper or aluminum wire. It should also be appreciated with the description that follows that various densities of warp or weft yarn wrap will be referenced and these densities will vary depending upon the type of yarn as described above and the desired characteristics of the non-woven product being manufactured.

Accordingly, one embodiment of this invention is directed to a composite fabric, which includes at least two non-woven fabric layers; a first non-woven layer having yarns aligned in the machine direction; and a second non-woven layer having yarns aligned substantially perpendicular to the machine direction.

Two additional embodiments of the present invention are (1) a continuous, in-line fabrication method and (2) apparatus for manufacturing such non-woven fabric.

The non-woven fabric of the present invention has the appearance of a woven fabric, but is considered a non-woven because the warp and weft yarns are not interlaced or interwoven, but instead are laid one over the other and adhered together.

One embodiment of the composite fabric of the present invention involves the use of warp yarns and weft yarns positioned substantially perpendicular to one another. The terms "substantially perpendicular" as used herein are meant to include angles that approximate 90 degrees, and include specifically a range of from about 85 to 95 degrees, preferably 87 to 93 degrees, more preferably 89 to 91 degrees and most preferably 89.5 to 90.5 degrees.

The two different yarns are adhered to one another with an adhesive material that is first set during the initial processing, and may be further set during pressure lamination. The yarn density can approach as high as 140 yarns per inch for a single strand 36 cotton count yarn. This is substantially higher than the density available in the same yarn count of a conventional woven fabric, which has a maximum yarn density of about 90 yarns per inch for the same yarn. The adhesive preferably represents less than 5–20% by weight of the entire structure.

The apparatus of the present invention includes a supply station for warp yarn material. For the purposes of this disclosure, warp yarn material will be any material or combination of yarns that has yarns or fibers primarily positioned to run in the machine direction of the apparatus and that are, at a minimum, coated with a thin coating of adhesive material. The apparatus further includes a warp yarn material delivery station where the warp yarn material is conformed longitudinally to the outer surface of a cylindrical support so as to extend longitudinally of the support, and a weft yarn application station through which the warp material passes. Once the composite fabric material (combined warp and weft yarns) has been formed, an adhesive situated between the non-woven fabric layers is heated and cooled to bond the layers. The bonded composite fabric material may be treated with high pressure and heat to make a more secure bond. However, this final pressure-bonding step is not mandatory, but it does increase the strength characteristics of the final composite product.

In the present invention, the weft yarn application station comprises an enclosed rotating drum that has a ring-like enclosure with a plurality of supplies of weft yarn material on separate individual spools, cones or the like. The drum has a cylindrical axial passage along its longitudinal axis through which the warp yarns with the overlying adhesive pass. The cylindrical axial passage is fitted with a conical aligner, which serves as the final guide for guiding the rotating weft yarns into position on the warp yarns in substantially perpendicular alignment. The conical aligner is a stationary unit, which has an angled or sloped surface directed toward the forward movement of the warp yarns. A slope ranging from about 30 to 60 degrees has been found to be effective, with a 45-degree slope being preferred.

Each of the weft yarns are delivered to a fixed point on the stationary conical aligner, and from that point each yarn falls down the slope of the aligner and finally falls into place on the cylindrical warp fabric yarns, landing on the adhesive on the exposed surface of the warp yarns. By use of the conical aligner of the present invention, the weft yarns do not overlap one another. Instead, the weft yarns bump one another down the aligner and onto the warp fabric, creating a tight packing of the individual fibers laid transversely around the adhesive and warp yarns as the drum rotates at about 500–600 rpm about its axis. Tension of the weft yarns is provided by the centrifugal rotation of the drum.

It will be appreciated that both the tensioning of the weft yarns and the conical aligner's guiding of the placement of the weft yarns at the surface of the warp yarn material, in conjunction with the rotation of the weft yarns around the warp yarn material results in very high accuracy of weft yarn placement. High accuracy of the yarn placement can result in high weft yarn packing density, uniformity of the weft yarn, structural engineering of the fabric based on known placement of the weft yarns, and overall improved performance of the product.

In a preferred embodiment of the apparatus, up to twelve spools of weft yarn material can be mounted within the rotating drum on a radial wall thereof even though the size of the drum can be increased or the density of the spools within the drum can be increased so as to allow for more or less than twelve spools. By providing twelve spools of material at a pre-determined equal circumferential spacing within the drum, the drum can be properly balanced so that it can be rotated at high rates of speed substantially without vibration. It is also important that the twelve spools, or however many are used, are at an exactly equal angular displacement relative to each other, for a uniform spacing of weft yarns. Exact angular displacement and the pushing of the weft yarns against the next adjacent weft yarn results in the weft yarns being precisely and controllably placed so as to optimize weft yarn packing. However, if a pattern is desired, this equal displacement could be modified.

The drum also has a separate power source for rotating the drum at a different speed than the power source at the take-up station in the apparatus, which advances the transfer belt and the warp yarn material through the apparatus. Accordingly, the warp yarn material can be moved linearly through the apparatus along the cylindrical support at a selected or varied rate of speed while the rate of rotation of the drum can be at an independent selected and variable speed. This allows the weft yarns to be wrapped around the warp yarn material at predetermined or desired spacing and also at an angle relative to the longitudinal axis of the warp yarn material. In other words, while the weft yarn material is wrapped substantially perpendicularly to the warp yarn material, in reality it is slightly offset from perpendicular and the angle of offset can be varied by varying the rate of rotation of the drum relative to the linear speed at which the warp yarn material is advanced through the drum. As the angle is varied, so is the average spacing of the weft yarns.

DETAILED DESCRIPTION OF THE PREFERRED EMBODIMENTS

Figure 1:
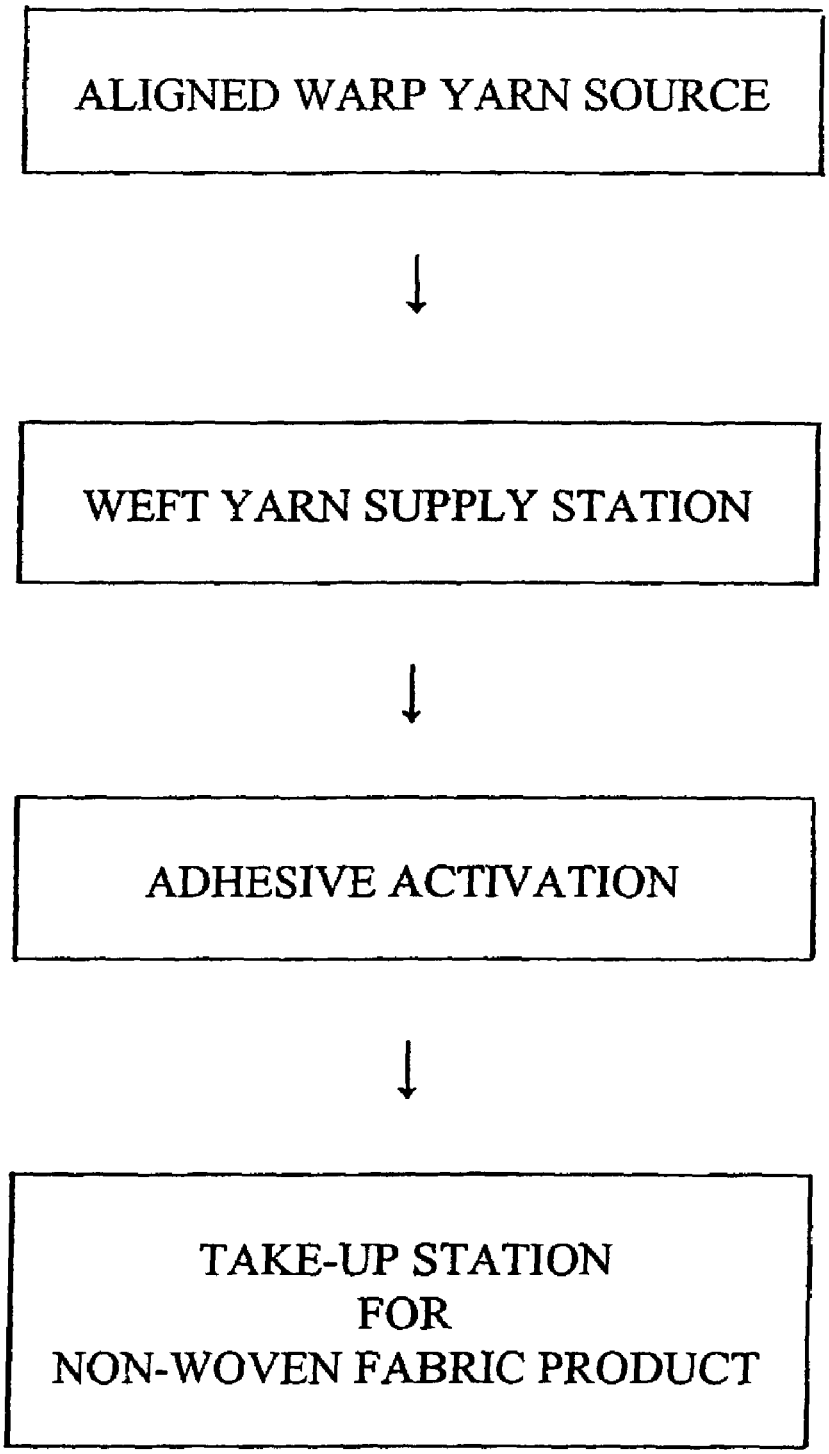
FIG. 1 is a flow-chart depicting the process of the present invention in which a source of aligned warp yarns is combined with a source of weft yarns and then an adhesive which binds the two yarn sources together is activated (heating and cooling) and thereafter a combined non-woven fabric product is collected at a take-up station. This material is useful "as is" or it may be further processed as described below.
Figure 2:
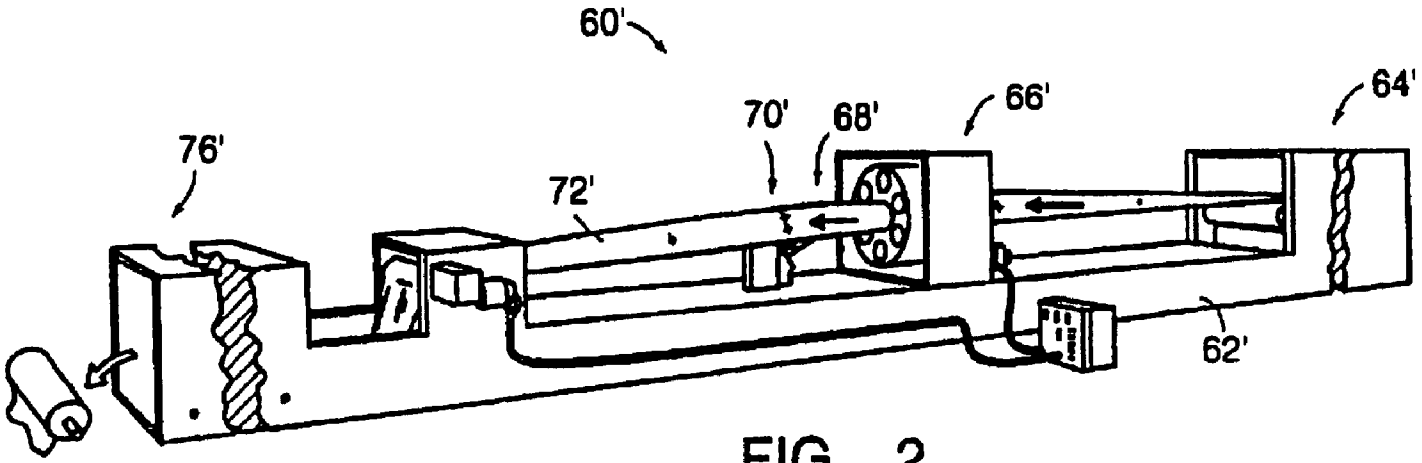
FIG. 2 is a diagrammatic side elevation of a preferred embodiment of the manufacturing apparatus of the present invention.

The non-woven fabric manufacturing apparatus 60 of the present invention is shown in FIG. 2 to include an elongated in-line framework 62 including a warp yarn material supply station 64, a weft yarn application station 66, a heating station 68, a cooling station 70, a flattening station 72, and a take-up station 76. From the take-up station, the composite non-woven fabric of this invention can either be used directly, for instance as a light filtering medium, or it can be pressure laminated into a high strength composite fabric, suitable for use under extreme conditions, e.g., as sail cloth fabric.

PCT Publication No. WO 00/41523 describes a non-woven warp yarn fabric material, which is one preferred layer of the composite fabric in the present invention. In general, this aspect of the PCT publication describes a preferred warp yarn material for use in the present invention. The substrate comprises a plurality of yarns that are formed into an aligned group, substantially parallel and equally spaced apart, and held together by a hot melt adhesive applied to one side of the fiber group. This fiber orientation, in which the fibers run in the machine direction, creates a non-woven fabric material substrate in which the fibers mimic warp yarns, which can be combined with one or more woven or non-woven fiber substrates and pressure laminated to create finished products that have superior strength characteristics but retain the visual impression and physical feel of a woven material.

PCT Publication No. WO 00/41523 also describes a pressure laminator for finalizing the processing of the composite material of the present invention. In general, this aspect of the PCT publication describes a dual belt driven, continuous pressure lamination apparatus that utilizes pressure, heat and cooling to bond at least two substrates (plies) with an adhesive between the layers of the substrates. This pressure laminator has been specifically designed to permit the permanent joining of at least two non-woven fabric substrates with an adhesive between the substrates, with little or no shrinkage occurring during the lamination process. The resulting non-woven fabric advantageously has the appearance of a woven fabric, but has superior strength characteristics there over.

Figure 4:
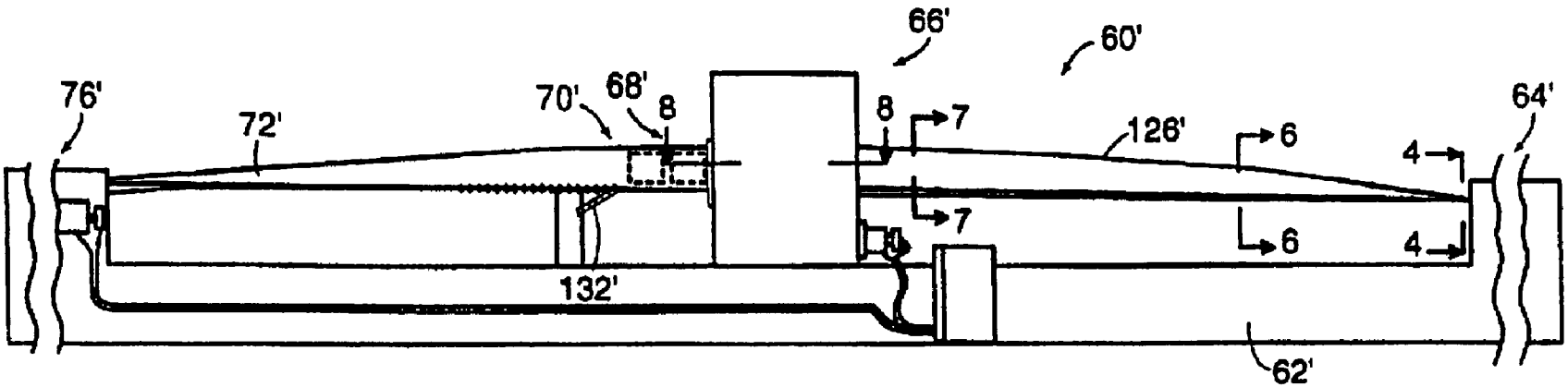
FIG. 4 is a fragmentary diagrammatic side elevation of the apparatus shown in FIG. 2.

As illustrated in FIGS. 2 and 4, a warp yarn material 78 is provided on a supply roll 80 at the warp yarn material supply station 64. Once in place at the supply station 64 of the apparatus of the present invention the warp yarn material 78 is passed on an endless, recycling transfer belt 124, preferably of PTFE (Teflon®). A series of bars and folding points (not shown) convert the flat sheet of warp yarn material into a curved or cylindrical shape. This folding box equipment is known in the art, and once the warp yarn material has the general shape of a cylinder, with the adhesive layer on the outside or exposed surface, the warp yarns are ready to be over wrapped with the weft yarn material.

Once formed into a cylindrical shape, the warp yarn material is advanced through the weft yarn application station 66 at a pre-determined rate with the warp yarn adhesive coating positioned on the exterior surface of the cylindrically configured warp yarn material. As the warp yarn material passes through the weft yarn application station, a series of weft yarns 128 radially located on a rotating drum 130 an equal distance from one another are wrapped transversely around the cylindrically configured warp yarn material at a predetermined rate and the resultant composite structure of warp yarn material 78, adhesive coating 116 and weft yarns 128 is then advanced through the heating station 68 where the adhesive coating is melted so that the adhesive will bond the warp yarn material and the weft yarns.

Immediately thereafter the composite material passes through the cooling or adhesive setting station 70 where the adhesive is set so as to no longer be tacky. The bonded fabric composite 131 progresses from the cooling station to the take-up station 76, a cutter 132, preferably a rotary cutter, longitudinally severs the cylindrical composite fabric material and the cut composite fabric material progressively changes from its cylindrical orientation, back to a generally flat orientation in the flattening station 72. At the downstream end of the flattening station, the belt passes down and around a drive roller 133 that underlies the endless belt, where the belt is returned to the supply station 64 via tensioning roller 135 and idler rollers 137. The drive roller, through its driving engagement with the endless belt, thereby advances the warp yarn material through the apparatus.

Figure 3:
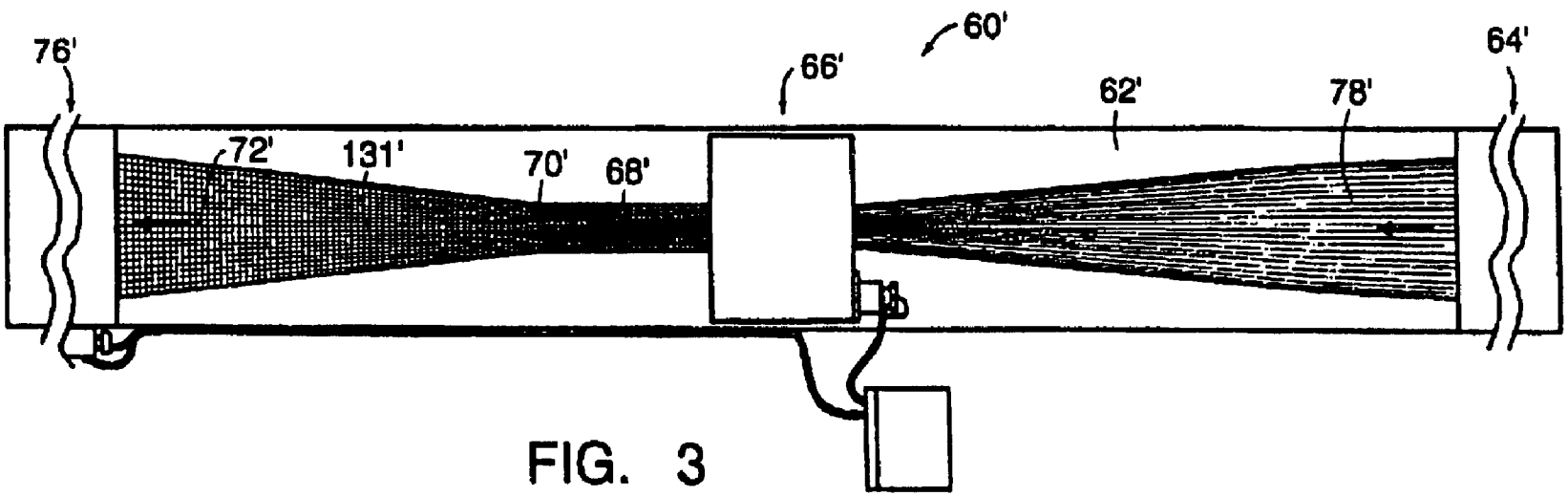
FIG. 3 is a fragmentary diagrammatic top elevation of the apparatus shown in FIG. 2 with the adhesive removed for clarity.

FIG. 3 is another diagrammatic view looking down on the apparatus shown in FIG. 2. This view illustrates the longitudinal, or machine direction orientation of the warp yarn material as it enters the weft yarn application station 66 and the resultant non-woven composite fabric product 131 extending from the weft yarn application station toward the take-up station 76.

The supply of warp yarn material 78 is disposed on the transfer roll 90 at the supply station and the yarns or fibers in the material 78 extend in parallel side-by-side relationship. A suitable braking or friction system (not seen) prevents the roll 110 from rotating freely and thus overrunning. The material is passed over an idler roller 144 onto the driven, endless recycling PTFE (Teflon®) belt 124 that supports the warp yarn material and advances it through the weft yarn application station. The PTFE (Teflon®) belt conforms to the support structure 126 and slides over a stainless steel wear plate.

Figure 5:
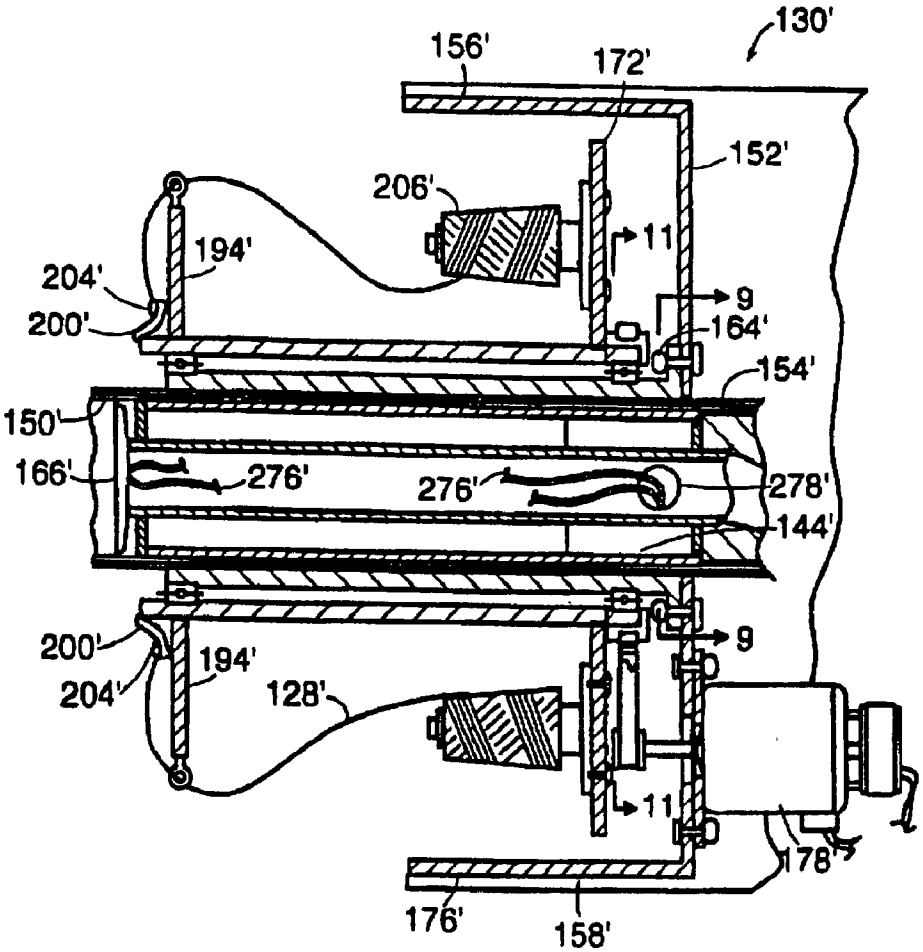
FIG. 5 is an enlarged fragmentary section taken along line 8—8 of FIG. 4.
Figure 8:
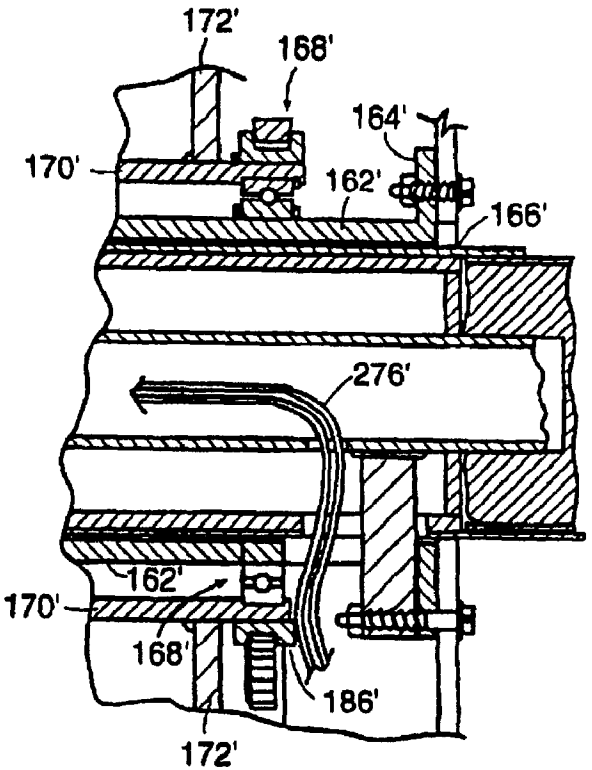
FIG. 8 is an enlarged fragmentary section taken along line 11—11 of FIG. 4 and having been rotate ninety degrees.

As seen in FIG. 5, at the weft yarn application station 66, the PTFE (Teflon®) belting 124 continues through the weft yarn application station and is supported by a rigid inner cylindrical ring 144 that extends substantially the full length of the weft yarn application station.

FIG. 5 illustrates the weft yarn application station 66, which includes an outer housing 146 having a rear or downstream wall 152 having an aligned circular opening 154 there through, a top wall 156, a bottom wall 158, and side walls 160. A rigid support ring 162 having a peripheral flange 164 at its upstream end is bolted or otherwise secured to the rear wall 152 of the housing and defines a cylindrical passage 166 through the weft yarn application station. An inner cylindrical surface of the support ring is circumferentially spaced from the belting as it extends through the weft yarn application station. The support ring carries at longitudinally spaced locations on its outer surface the inner races of large diameter thin section ball bearings 168 such as of the type provided by Kaydon Corp. of Sumter, S.C. Outer races of the ball bearings respectively support another cylindrical body 170 that forms the inner cylindrical wall of the rotating drum. The inner cylindrical wall of the rotating drum supports a front radial wall 172 at the upstream end of the drum and radial wheel 194 at the downstream end of the drum, and the radial walls support an outer cylindrical wall 176 of the drum. The radial wheel 194 has guideposts 195 on the outer edges for delivering the weft yarns to the warp ring. The innermost portion of the radial wheel terminates at the conical aligner 200, which has a radiused, curved or sloped surface. The conical aligner 200 guides the weft yarns into a substantially perpendicular alignment with the warp yarns.

Figure 7:
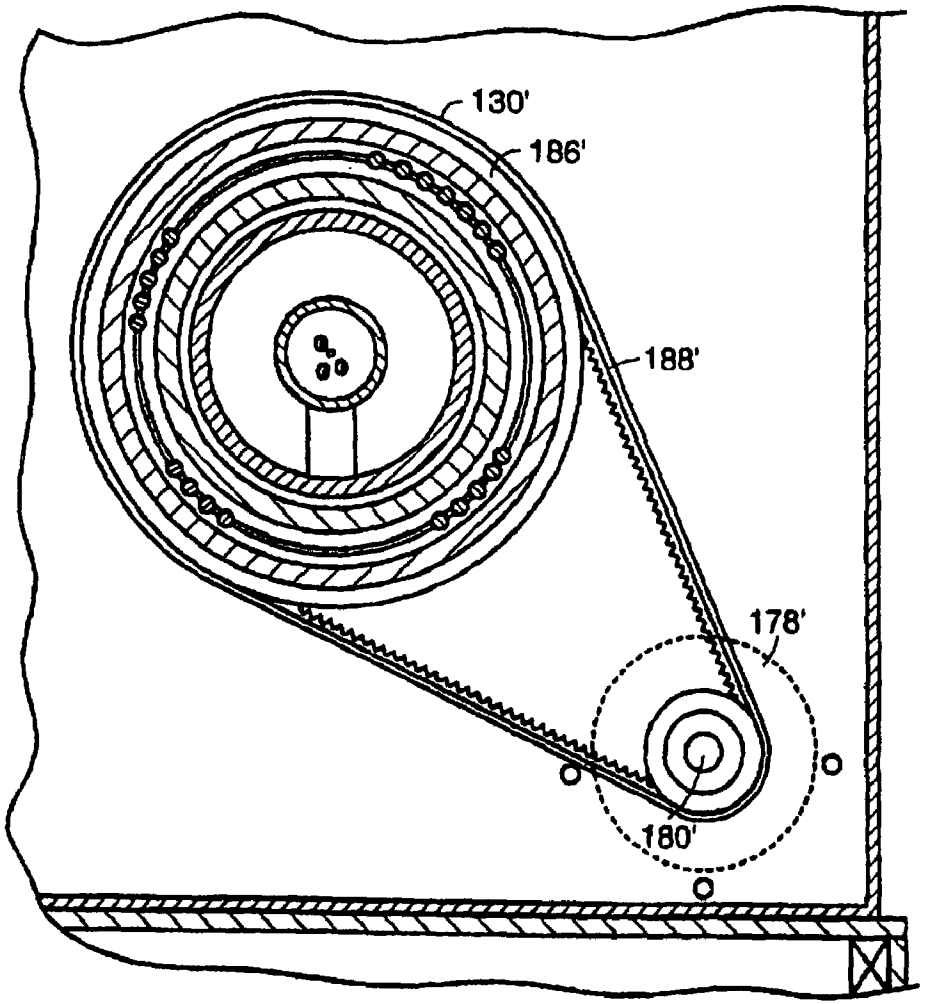
FIG. 7 is an enlarged fragmentary section taken along line 10—10 of FIG. 6.

As shown in FIG. 7, a variable speed electric motor 178, serving as power means for the weft yarn application station, is mounted on the upstream face of the front wall 148 of the housing and has a drive shaft 180 that extends into the interior of the housing and supports a drive pulley 182 that is aligned with one of the ball bearings 168. The inner cylindrical wall 170 supports a pulley 186 around which a drive belt 188 extends so as to operably interconnect the drum with the drive pulley 182 of the electric motor. Energization of the electric motor thereby rotates the drum at variably selected speeds. The details of the mounting of the ball bearing and drive belt is probably best seen in the enlarged view in FIG. 7.

Figure 9:
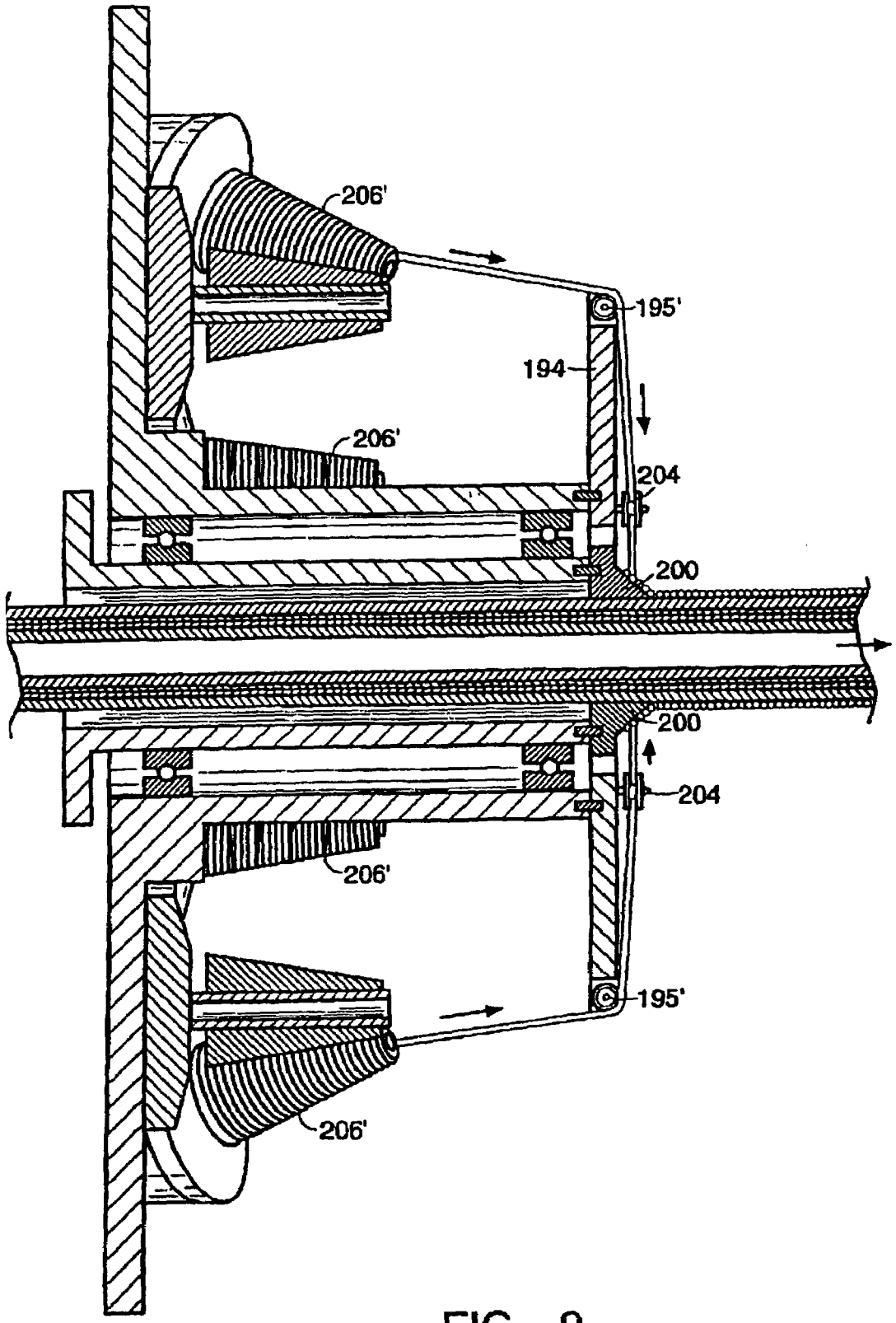
FIG. 9 is a side cutaway of the conical aligner showing how the weft yarns are delivered to the warp yarn surface in a tightly packed arrangement.
Figure 10:
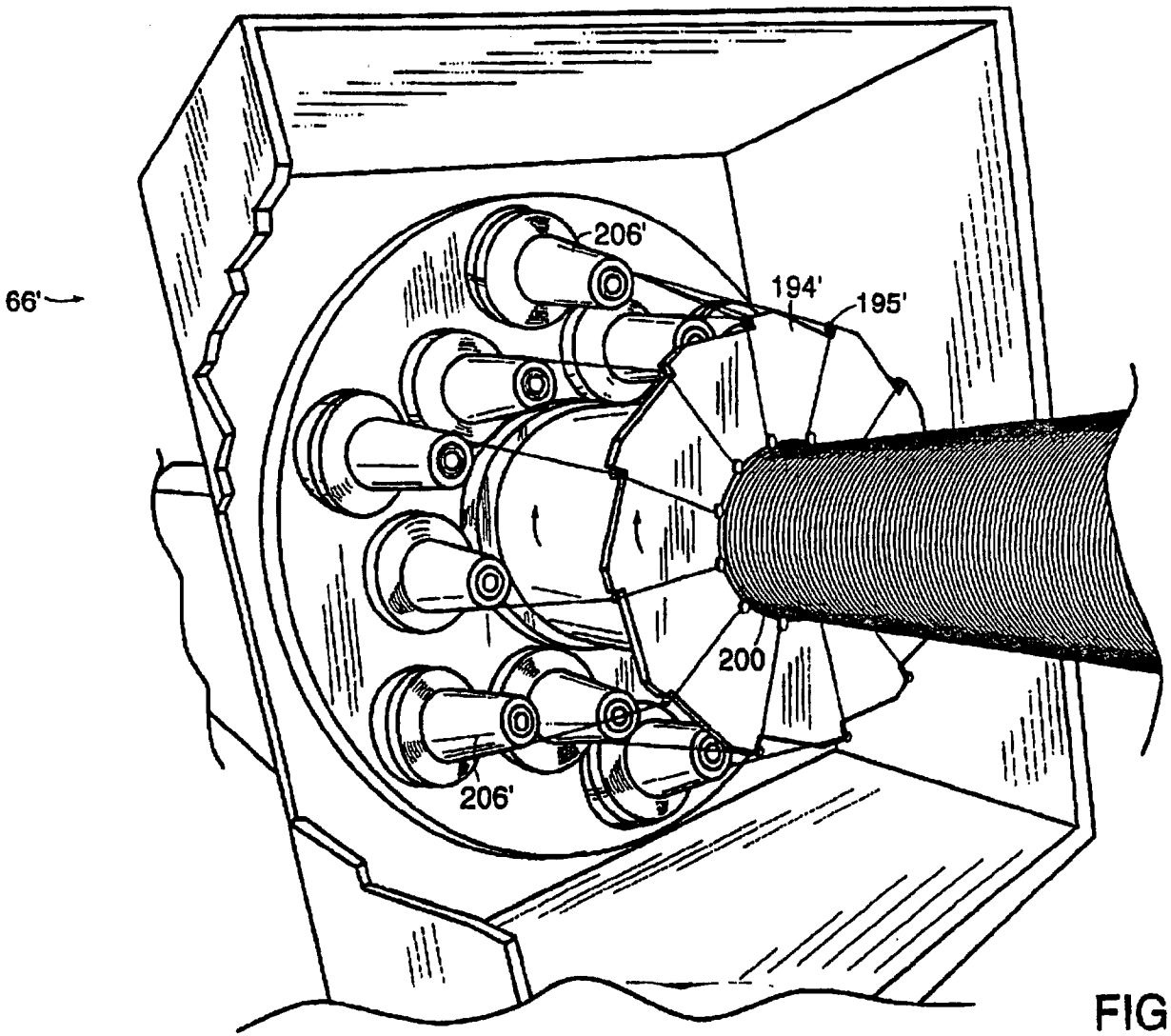
FIG. 10 is a perspective view showing the weft yarns being applied at wide spacing to the warp yarn cylinder, showing how the weft yarns slide down the conical aligner face to drop precisely down on the warp yarn material.

A plurality of source supplies of weft yarn material are provided in the form of spools 200 of such material and are removably mounted on the inner surface of the front wall 172 of the rotating drum, again in circumferentially spaced relationship and alignment with the circular openings 190 in the rear wall of the drum. It should be appreciated that the number of spools of weft yarn material could vary and while the disclosed embodiment shows six such spools, more or less could be used, in a preferred embodiment, twelve such spools are used. The weft yarn material is extended from a spool 206 to the eyelet 198 on disk 194 and then passed radially inwardly down the face of disk 194 to another eyelet at the base of disk 194. This is best seen in FIGS. 9 and 10.

As the weft yarn application drum rotates, the weft yarns are delivered through eyelet 204 on disk 194, and the yarns slip down the curved slope of the conical aligner 200, by which each yarn is delivered to the warp in a substantially perpendicular alignment. FIG. 9 best illustrates the conical aligner of the present invention. As shown therein, the conical aligner 200 is a stationary device, with a surface angle or slope, which faces the direction of travel of the warp yarn materials. The weft yarns are delivered to the surface of the conical aligner by rotatory pulleys operating in conjunction with the rotating drum. The individual weft yarns are each delivered to substantially the same spot on the sloped surface of the conical aligner. They fall down the sloped surface, and are forced, one after the other, down into a tight spacing on the surface of the adhesive coated warp yarns. FIG. 10 shows a perspective view of the application of weft yarns, in a wide spacing manner, to the warp yarns. Once the weft yarns have been applied to the warp yarn material, the adhesive between the yarns must be heated and cooled to form a non-woven fabric. These steps are conducted in the next part of the apparatus as discussed below.

Figure 6:
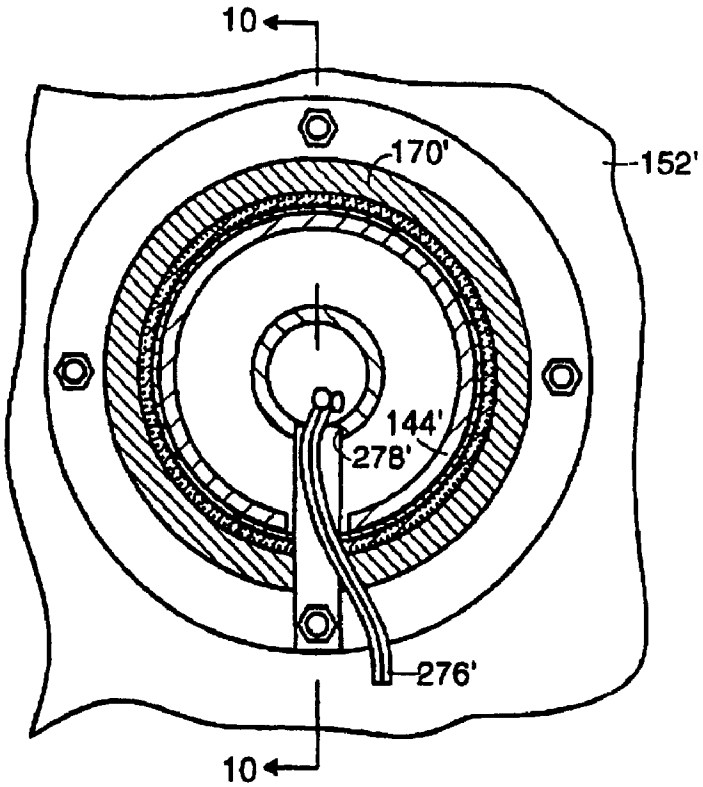
FIG. 6 is an enlarged fragmentary section taken along line 7—7 of FIG. 4.

The adhesive heating station 68 consists of a steel or other heat transmitting cylindrical core 272 that is positioned interiorly of the belt 124 immediately downstream from the weft yarn material application station 66 and forms an axial extension of the rigid cylindrical ring 162 in the weft yarn application station. Resistive heat elements 274 are circumferentially positioned around the steel core 272 with the resistive heat elements connected to an electrical source by wiring 276 as possibly best seen in FIG. 6, which passes through the cylindrical ring support in the weft yarn application station and outwardly of the apparatus through a circular aperture 278 therein so that it can be plugged into an electrical power source in a conventional manner. When an electrical current is applied to the resistive elements, the metal core 272 is heated thereby radiating heat outwardly through the warp yarn material, the adhesive on the warp yarn material, and the overlying layer of weft yarn material. The heat is controlled to sufficiently melt the adhesive to bond the warp and weft yarns together.

As the composite fabric material 131 of bonded warp and weft yarns is moved downstream, it next encounters the cooling or adhesive setting station 70 which, again, includes a steel or other heat conductive cylinder 280 which immediately underlies the belt 124. A heat transfer system 282 interiorly of the cylinder 280 uses circulating coolant from inlet and outlet tubes 284, respectively, in a conventional manner to remove heat from the composite fabric material. The coolant transfer tubes (not shown) are connected to the heat transfer system so that a continuous supply of coolant fluid can be circulated through the cooling station to set the adhesive thereby securely bonding the warp and weft yarn material.

As the composite fabric material 131 leaves the cooling station 70 and is moved further downstream, it engages the fabric cutter 132 that is conventional and is mounted on a bracket 286. The cutter serves to sever the composite fabric material 131 along its length as it is moved along the apparatus.

As the material progresses further downstream after being cut, it is flattened out as the support structure 126 transgresses from a cylindrical configuration to a flat configuration in the flattening station 72. Accordingly, as the non-woven composite fabric material reaches the drive roller 133 and then passes to the take-up station 76, it has been flattened on the belt 124 and is wrapped around the take-up roll 136 until a desired amount of fabric material has been accumulated. The take-up roller can then be removed from the machine and replaced with another take-up roller to continue the process.

Although the present invention has been described with a certain degree of particularity, it is understood that the present disclosure has been made by way of example, and changes in detail or structure may be made without departing from the spirit of the invention as defined in the appended claims.

What is claimed is:

1. An apparatus for forming a non-woven fabric product having substantially perpendicular warp yarns and weft yarns, said apparatus comprising in combination:

a warp yarn support system including an elongated substantially cylindrical support structure extending along the length of said warp yarns and having a low-friction, substantially cylindrical outer surface;

an endless belt extending along the length of said warp yarns and movable along the length of said support structure;

a supply of elongated parallel warp yarns that are positioned side-by-side upon said endless movable belt along the length of said support structure and that have a coating of adhesive at least on their exposed surfaces, preferably only on their exposed surfaces;

a delivery system for weft yarn including: a drum mounted for rotation about said support structure, about said endless belt and about said warp yarns, power means for rotating said drum about said support structure endless belt and warp yarns, at least one source of supply of said weft yarn mounted on said drum for rotation therewith, and a guide system for delivering said weft yarn from said source of supply of said weft yarn to said adhesive coated outer surface of said warp yarns upon rotation of said drum, such that said weft yarn is wrapped about said warp yarns in substantially perpendicular relationship therewith;

a driven system that is operatively connected to said endless belt for moving said warp yarns along the length of said support structure and through said weft yarn delivery system;

a heater for activating said adhesive to bond yarns, between which is said adhesive; and a conical alignment guide which is positioned immediately adjacent said drum and immediately adjacent to, and about, said warp yarns, and about which said weft yarn is wound prior to falling down upon, and being wound about, said warp yarns and said coating of adhesive on said exposed surfaces of said warp yarns.

2. The apparatus of claim 1 wherein the parallel warp yarns have a coating of adhesive only on their exposed surfaces.

3. The apparatus of claim 2 wherein said conical alignment guide is downstream of said drum.

4. The apparatus of claim 1 wherein said conical alignment guide is stationary and has a sloped surface, facing in the direction of movement of said warp yarns.

5. The apparatus of claim 4 wherein said conical alignment guide has a sloped surface of about 30 to 60 degrees.

6. The apparatus of claim 5 wherein said conical alignment guide has a sloped surface of about 45 degrees.

7. The apparatus of any one of claims 1,2,4,5,6 and 3 wherein said conical alignment guide is a final guide for guiding a rotating weft yarn on to said warp yarns in substantially perpendicular alignment.

8. The apparatus of claim 7 wherein said source of supply of said weft yarn is a spool or cone of a weft yarn.

9. The apparatus of claim 8 wherein said source of supply of said weft yarn is a plurality of spools of weft yarns that are mounted on said drum in circumferentially spaced relationship.

10. The apparatus of claim 9 wherein said drum comprises a hollow ring which surrounds said support structure, which has said plurality of spools of said weft yarns mounted away from said support structure and which has a radial disk that is spaced away said plurality of spools and that surrounds said conical alignment guide, so that said weft yarns extend from said plurality of spools to said disk and then vertically to said conical alignment guide.

11. The apparatus of claim 10 wherein said radial disk is downstream from said plurality of spools and said weft yarns extend downstream from said plurality of spools.

12. The apparatus of claim 10 wherein said weft yarns are wrapped about said warp yarns so as to establish 40–100 wraps of said weft yarns per inch along the length of said warp yarns.

13. The apparatus of claim 12 wherein said warp yarns have a density of 40–100 yarns per inch.

14. The apparatus of claim 10 wherein said heater is downstream from said weft yarn delivery system.

15. The apparatus of claim 10 wherein a driven take-up system is downstream from said weft yarn delivery system and is operatively connected to said warp yarns for moving said warp yarns along said support structure and through said warp yarn delivery system.

16. The apparatus of claim 10 which further comprises a cooler, downstream of said heater, to set said adhesive that bonds weft and warp yarns, between which is said adhesive.

17. The apparatus of claim 9 wherein said weft yarns are wrapped about said warp yarns so as to establish 40–140 wraps of said weft yarns per inch along the length of said warp yarns.

18. The apparatus of claim 17 wherein said warp yarns have a density of 40–140 yarns per inch.

19. The apparatus of claim 9 wherein said heater is downstream from said weft yarn delivery system.

20. The apparatus of claim 9 wherein a driven take-up system is downstream from said weft yarn delivery system and is operatively connected to said warp yarns for moving said warp yarns along said support structure and through said warp yarn delivery system.

21. The apparatus of claim 9 which further comprises a cooler, downstream of said heater, to set said adhesive that bonds weft and warp yarns, between which is said adhesive.

22. The apparatus of claim 7 wherein said heater adhesively bonds said wrapped weft yarn to said warp yarns to form a cylindrical fabric and wherein said apparatus further comprises, downstream of said heater, means, for cutting said cylindrical fabric into a flat fabric.

23. The apparatus of claim 22 wherein said means for cutting is a rotary cutter.

24. The apparatus of claim 7 wherein said heater is downstream from said weft yarn delivery system.

25. The apparatus of claim 7 wherein a driven take-up system is downstream from said weft yarn delivery system and is operatively connected to said warp yarns for moving said warp yarns along said support structure and through said warp yarn delivery system.

26. The apparatus of claim 7 which further comprises a cooler, downstream of said heater, to set said adhesive that bonds weft and warp yarns, between which is said adhesive.

27. The apparatus of claim 7 wherein said driven system for said endless belt and said power means for rotating said drum are independently operated and at least one is variably driven such that the angle of wrap of said weft yarn relative to said warp yarns is variable.

* * * * *